United States Patent [19]

Bako

[11] 4,356,712

[45] Nov. 2, 1982

[54] HARDWARE ASSEMBLY FOR LUGGAGE AND THE LIKE

[75] Inventor: Lazlo Bako, Woodcliff Lake, N.J.

[73] Assignee: Presto Lock, Inc., Garfield, N.J.

[21] Appl. No.: 157,616

[22] Filed: Jun. 9, 1980

[51] Int. Cl.[3] ..... E05B 65/52; E05B 37/02; E05B 15/16

[52] U.S. Cl. ..... 70/69; 70/312; 70/333 A

[58] Field of Search ..... 70/67, 69, 70, 71, 72, 70/73, 74, 75, 76, 312, 333 A

[56] References Cited

U.S. PATENT DOCUMENTS

| | | | |
|---|---|---|---|
| 759,278 | 5/1904 | Horner . | |
| 897,377 | 9/1908 | King . | |
| 928,904 | 7/1909 | Cottrell . | |
| 1,002,338 | 9/1911 | Tamburini | 70/333 A |
| 1,123,886 | 1/1915 | Kaszewski | 70/333 A |
| 1,593,226 | 7/1926 | Stuart . | |
| 1,920,189 | 8/1933 | Dorst . | |
| 2,136,493 | 11/1938 | Denerich . | |
| 2,238,480 | 4/1941 | Tierney . | |
| 3,677,042 | 7/1972 | Atkinson . | |
| 3,800,571 | 4/1974 | Heine . | |
| 3,942,344 | 3/1976 | Gehrie . | |
| 3,952,561 | 4/1976 | Bako . | |
| 3,961,505 | 6/1976 | Gehrie . | |
| 4,100,775 | 7/1978 | Bako . | |
| 4,281,525 | 10/1978 | Bako | 70/312 |

FOREIGN PATENT DOCUMENTS

| | | | |
|---|---|---|---|
| 2423608 | 11/1979 | France | 70/69 |

*Primary Examiner*—Robert L. Wolfe
*Attorney, Agent, or Firm*—Shapiro and Shapiro

[57] ABSTRACT

A hardware assembly for luggage and the like includes a latch pivotally supported on a luggage case and held in a closed position by engagement between catch elements on the latch and cooperating catch elements on a control member supported for movement along the case, the control member being biased in a direction to engage the catch elements. A pivoted manual actuator associated with the latch engages the control member and is capable of moving the control member in a direction to disengage the catch elements to allow the latch to be opened, when the manual actuator is operated. The catch elements serve as a safety catch to prevent the latch from being opened until the catch elements are disengaged. The hardware assembly may further include a latching slide member coupled to the latch by a link member for movement with the latch, and for engaging a cooperable latch element on a second part of the case when the latch is in the closed position. A combination lock may also be included for blocking movement of the control member necessary to open the latch.

41 Claims, 23 Drawing Figures

HARDWARE ASSEMBLY FOR LUGGAGE AND THE LIKE

BACKGROUND OF THE INVENTION

This invention relates to hardware assemblies for luggage and the like and is more particularly concerned with luggage hardware employing one or more pivoting latches controlled by a combination lock.

U.S. Pat. No. 3,961,505 to Gehrie, issued June 8, 1976, and assigned to the same assignee as the present invention, discloses a hardware assembly for a luggage case in which a single manual actuator and combination lock are effective to control the release of a pair of pivoting latches spring-biased toward open position. The latches control latching slide members, and are coupled to the actuator by a pair of elongated control rods having catch elements engageable with cooperating catch elements on the latches to hold the latches in a closed position. Turning the actuator forces the control rods apart, disengaging the catch elements and allowing the latches and the case to open. In this hardware, the mechanism that controls the latches depends upon butt relationships and has certain complexities and close tolerances that increase the expense of the luggage hardware.

U.S. patent application Ser. No. 949,992, filed Oct. 10, 1978, and also assigned to the same assignee as the present invention, discloses a simpler hardware assembly in which a single combination lock controls a pair of pivoting latches which are springbiased toward open position. Separate manual actuators are provided for each latch, and each latch has a latch element attached thereto which directly engages a hasp on a cooperable part of the luggage case. Operation of the manual actuators allows the latches to open, disengaging the hasps and allowing the case to be opened.

Although hardware assemblies which employ pivoting latches, such as those described above, facilitate the opening and closing of luggage, their latching mechanisms may permit the inadvertent opening of the luggage case. For example, if the luggage case is dropped or jarred, one or both of the latches may pop open, allowing the case to open and subjecting the open latch to damage.

SUMMARY OF THE INVENTION

It is accordingly an object of the invention to provide an improved hardware assembly for luggage and the like that has the advantages of pivoting latches controlled by a single combination lock, but which provides more secure and reliable latching than comparable hardware of the prior art.

Another object of the invention is to provide an improved hardware assembly for luggage that is simpler, less expensive and more versatile than comparable prior art hardware assemblies.

A further object of the invention is to provide an improved hardware assembly for luggage which does not require a specially fabricated valance for mounting the assembly on a luggage case.

Briefly stated, in accordance with one aspect of the invention, a hardware assembly for luggage and the like comprises a latch, means for pivotally supporting the latch on a first part of a luggage case for movement between open and closed positions; control means supported for movement along the case, the control means having catch elements which are engageable with cooperating catch elements on the latch to hold the latch in the closed position; manual actuator means; and means for pivotally supporting the manual actuator means on the case adjacent to the latch, the manual actuator means being movable between a rest position and a release position, and being engageable with the control means for moving the control means in a direction to disengage the catch elements and release the latch for movement to the open position when the manual actuator means is moved to the release position.

In accordance with a further aspect of the invention, a hardware assembly for luggage and the like comprises a latch mounting plate formed for attachment to a first part of a luggage case, a latch pivotally supported near one end thereof on the latch mounting plate for movement between open and closed positions, manual actuator means pivotally supported on the latch mounting plate near the opposite end of the latch for movement between a rest position and a release position, and means engageable with the latch for holding the latch in the closed position, movement of the manual actuator means to the release position being effective to disengage the latch and the holding means to allow the latch to be moved to the open position.

In accordance with a further aspect of the invention, a hardware assembly for luggage cases and the like comprises a pair of handle studs adapted to be mounted on a luggage case adjacent to an edge thereof, each handle stud having an open end for receiving a mounting element of a handle, and a combination lock supported between the handle studs, the combination lock having a faceplate with up-turned end portions positioned within each handle stud adjacent to the open ends, the up-turned end portions providing bearing surfaces for the mounting elements of the handle received in the open ends.

In accordance with another aspect of the invention, in a hardware assembly for luggage cases and the like, a combination lock comprises a frame, a faceplate attached to the frame, the faceplate having a plurality of slots therein, a shaft supported on the frame, a plurality of dials rotatably supported on the shaft and extending through the slots in the faceplate, a bolt pivotally supported on projections on the frame for movement between locked and unlocked positions, means coupled to the dials and rotatable therewith for moving the bolt to the locked position except when the dials have predetermined rotational positions, and spring means located on the projections for urging the bolt to the unlocked position.

DETAILED DESCRIPTION OF THE PREFERRED EMBODIMENTS

A hardware assembly, such as a console assembly, employed on luggage cases and the like typically includes a pair of spaced latches, a pair of spaced handle studs supporting a handle, and one or more locks for controlling the latches. The hardware assembly may be mounted on a valance member attached to the edge of one part of the case, or the assembly may be mounted directly on the side of the case adjacent to a valance member, if the side is sufficiently sturdy to support the assembly. Cooperating hasps formed to be releasably retained by the latches are provided on a corresponding hinged part of the case. The invention is particularly adapted to luggage hardware of this type and will be described in that environment; however, the following description is merely illustrative of one utility of the invention.

Figure 1:
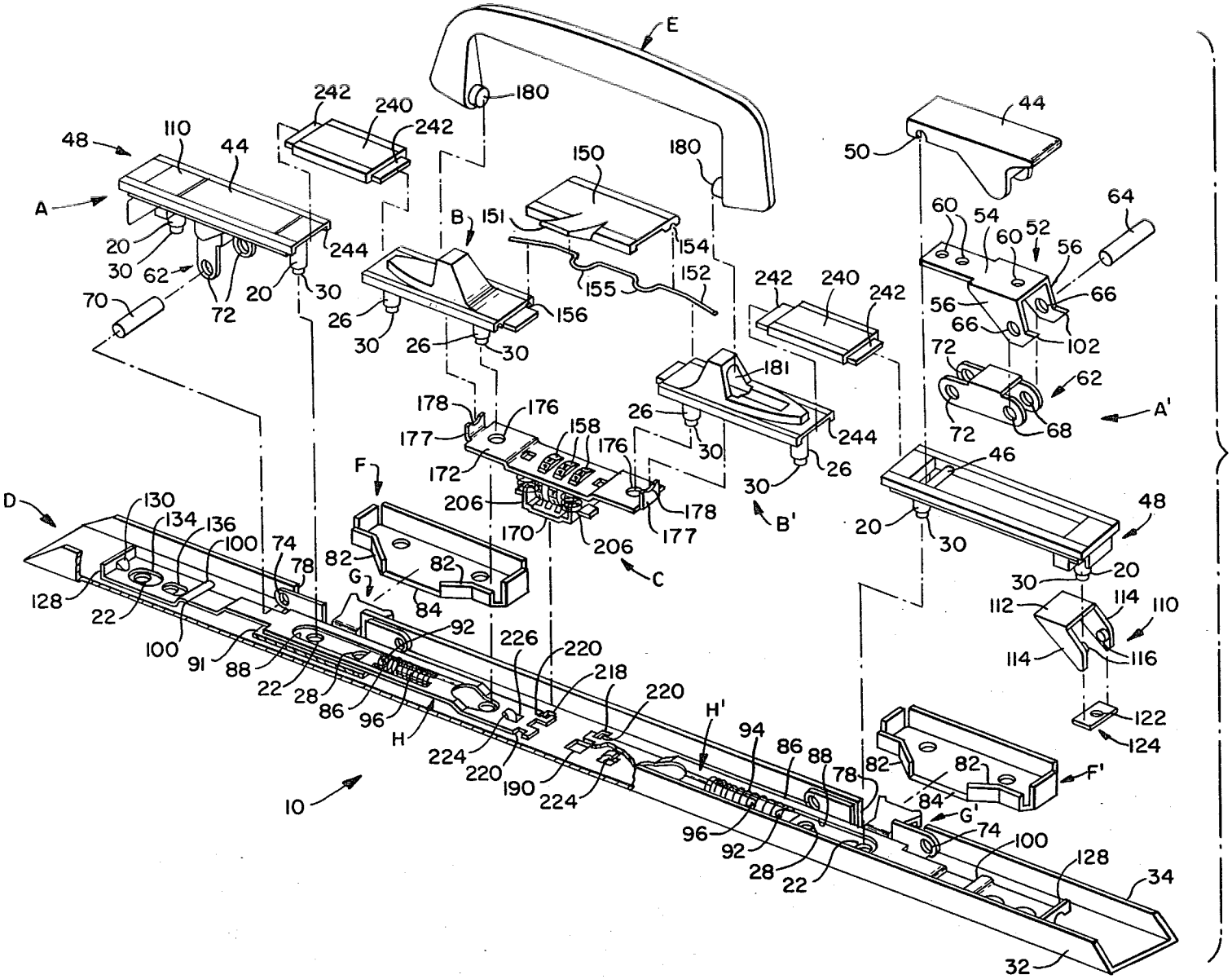
FIG. 1 is an exploded perspective view, partially broken away, illustrating a hardware assembly in accordance with a first embodiment of the invention.

As shown in FIG. 1, a hardware assembly 10, such as a console for a luggage case, in accordance with a first embodiment of the invention may include latch assemblies A, A', handle studs B, B' and a combination lock C supported on an elongated support member or channel D. As will be described in detail hereafter, a carrying handle E may be attached to handle studs B, B'; a latching slide member G, G' may be associated with each latch assembly for releaseably engaging an associated hasp F, F' on a cooperable part of the luggage case; and a pair of control members H, H' may be disposed for reciprocation in channel D to control the operation of the latch assemblies.

Figure 2:
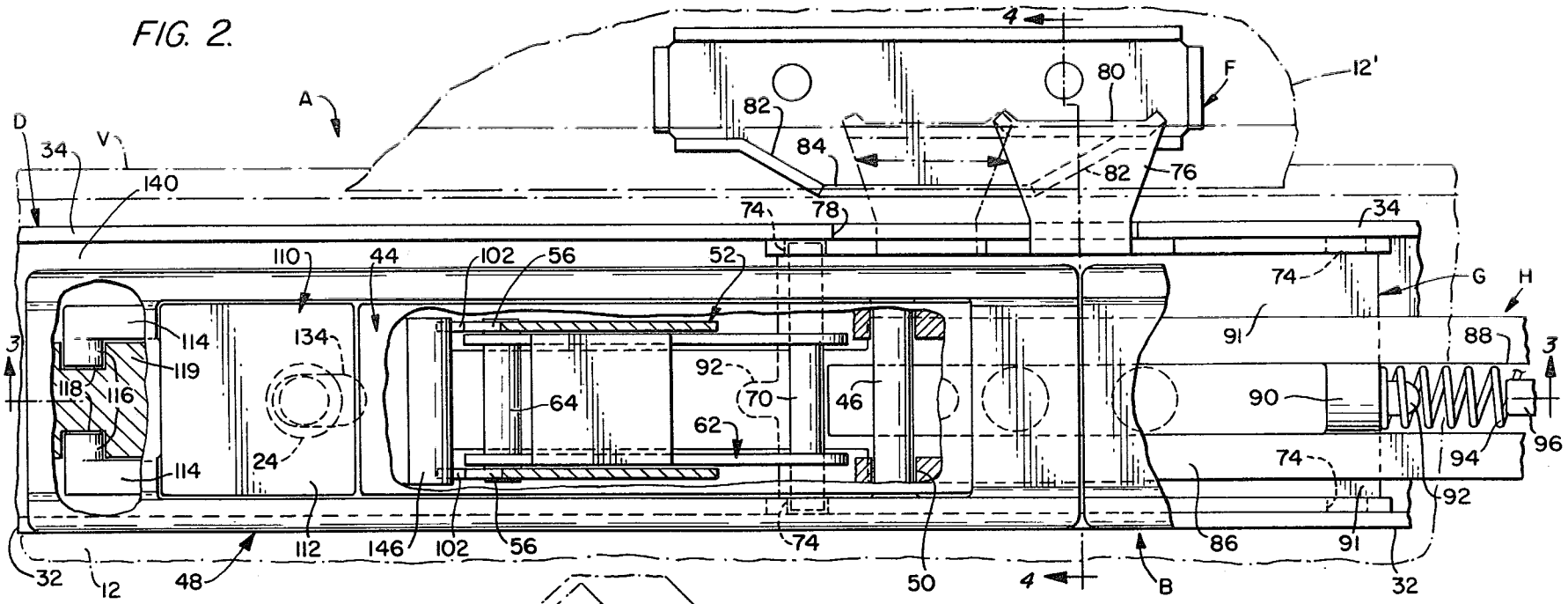
FIG. 2 is a top plan view, partially broken away, illustrating a latch assembly and associated parts employed in the first embodiment of the invention.
Figure 3:
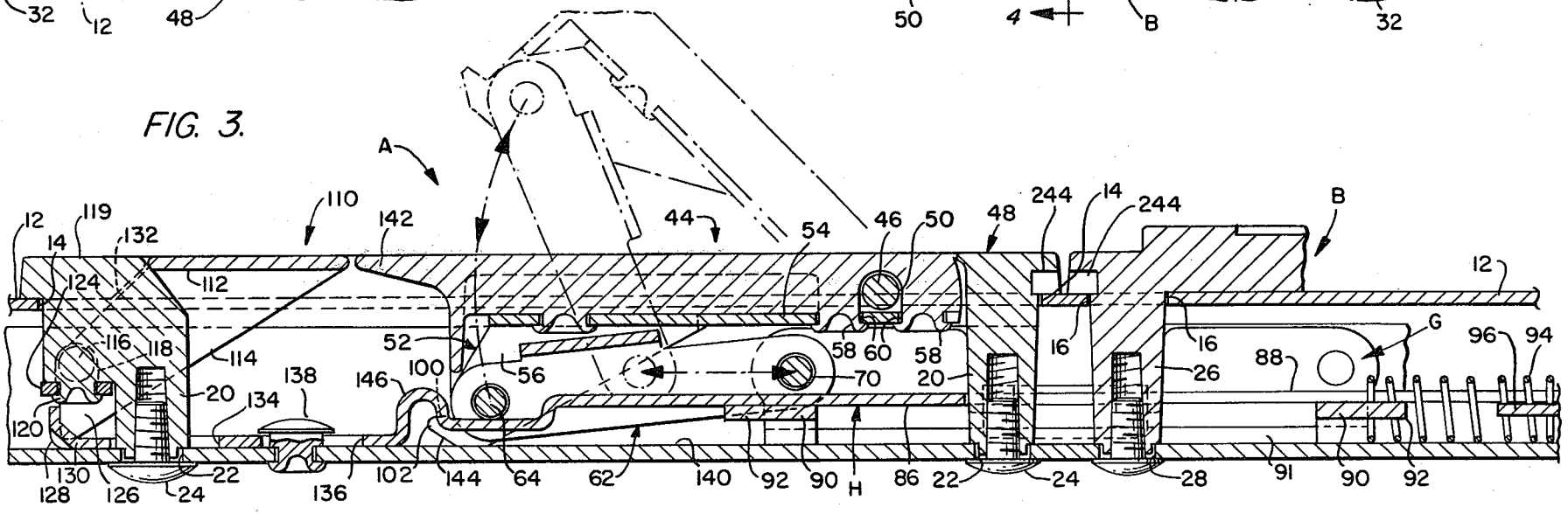
FIG. 3 is a longitudinal sectional view taken approximately along the line 3—3 of FIG. 2.
Figure 4:
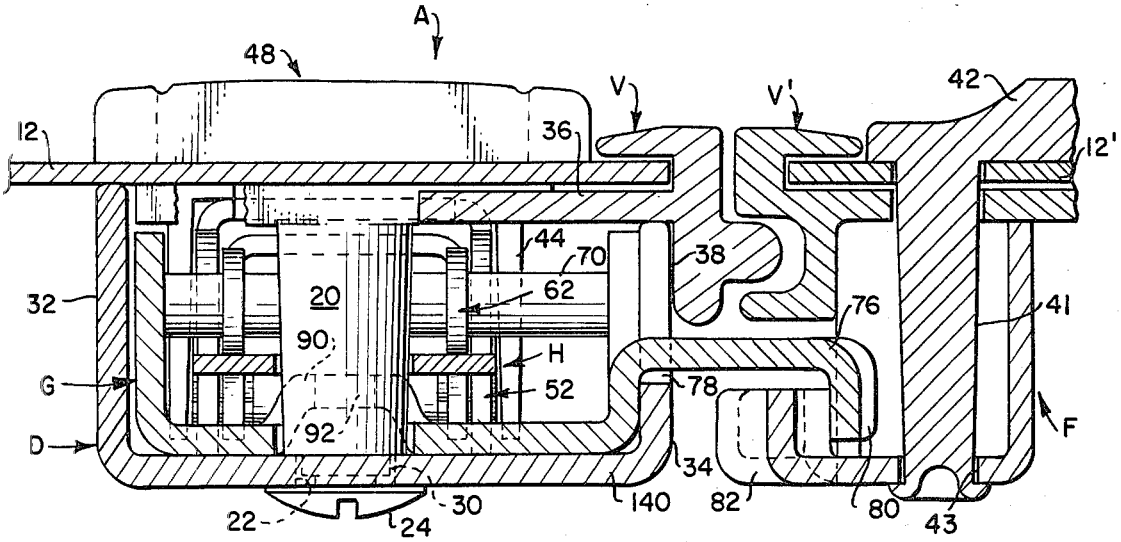
FIG. 4 is a transverse sectional view taken approximately along the line 4—4 of FIG. 2.
Figure 7:
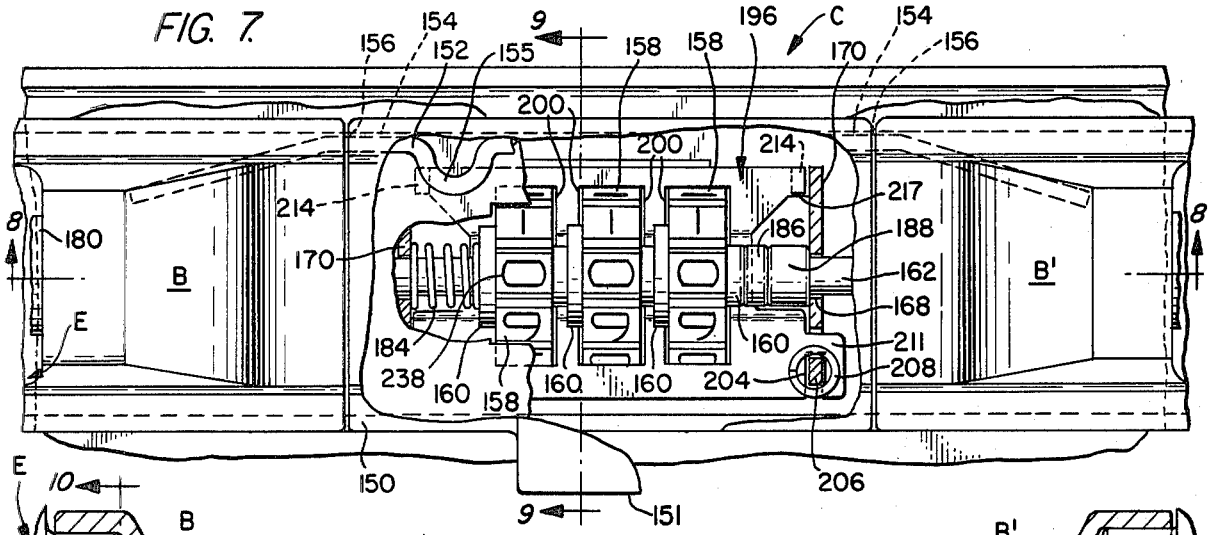
FIG. 7 is a top plan view, partially broken away, of a combination lock employed in the first embodiment of the invention.
Figure 8:
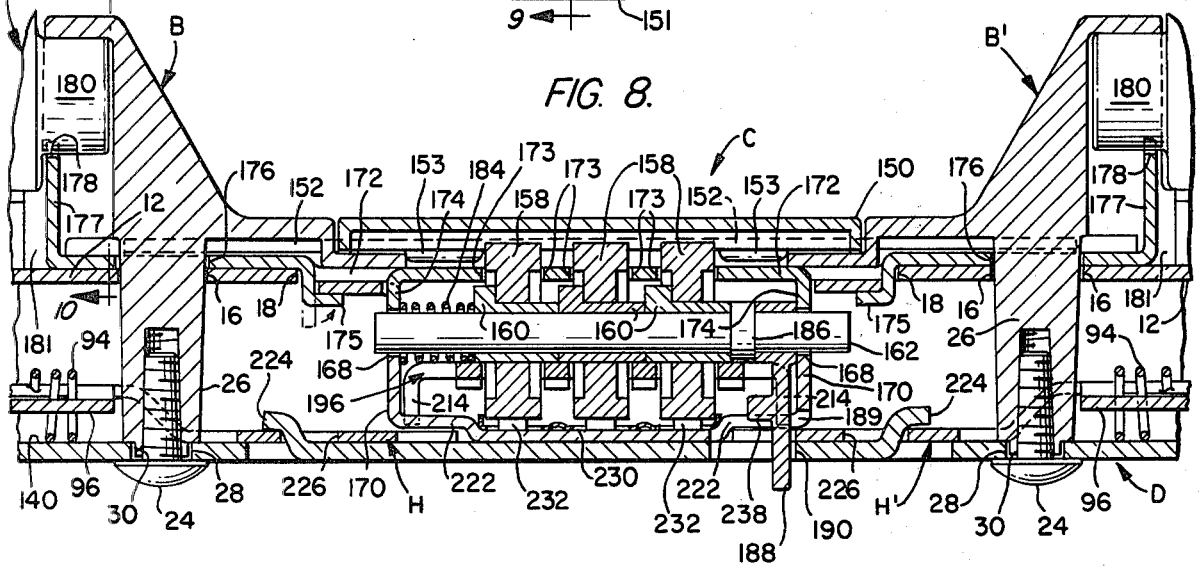
FIG. 8 is a longitudinal sectional view taken approximately along the line 8—8 of FIG. 7.
Figure 9:
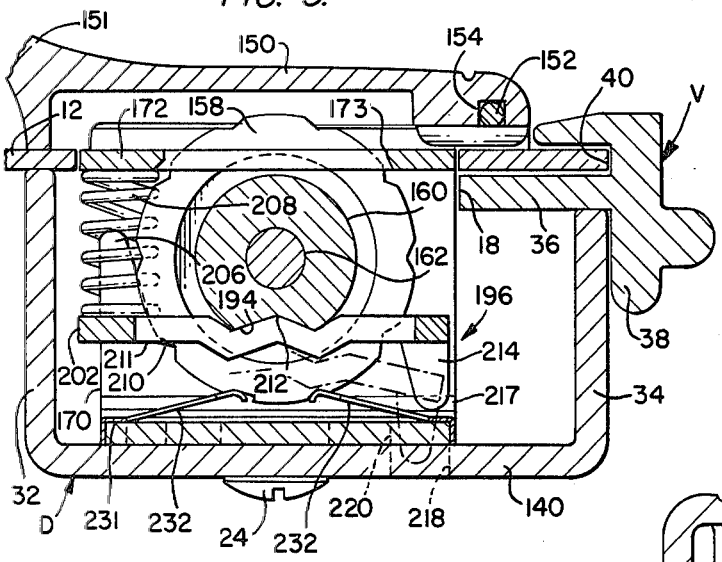
FIG. 9 is a transverse sectional view taken approximately along the line 9—9 of FIG. 7.

In the first embodiment of the invention illustrated in FIGS. 1-16, hardware assembly 10 may be mounted directly on a side 12 of one part of a luggage case adjacent to a valance member V, as shown in FIGS. 4 and 9. Hasps F, F' may be mounted on a side 12' of a second part of the luggage case adjacent to a mating valance member V', the hasps being positioned to be releasably engaged by the slide members G, G' when the parts of the case are brought together. Side 12 may have cut-outs 14 (FIGS. 3, 5 and 6) for receiving the latch assemblies, and may have cut-outs 16 and 18 (FIGS. 3 and 8) for receiving the handle studs and the combination lock, respectively. The latch assemblies and the handle studs may have depending studs or shanks 20, 26, respectively, aligned with corresponding openings 22, 28, respectively, in channel D for attaching the latch assemblies and the handle studs to the channel, as shown in FIGS. 3, 4, 5, 6, and 8. For this purpose, studs 20 and 26 may be internally threaded for receiving threaded fasteners 24, and may have notched end portions 30 which fit into respective openings in the channel for precisely locating the latch assemblies and the handle studs on the channel.

As shown in FIGS. 4 and 9, when assembled, one side wall 32 of channel D abuts side 12 of the case, and the other side wall 34 of the channel abuts an inner flange 36 and a depending portion 38 of valance member V, so that the portion of the hardware assembly associated with and including channel D is attached to side 12 with channel D positioned along the edge 40 of the case. The valance member V' and the hasps may be attached to the corresponding side 12' of the case along the edge 40' by rivets 41 depending from finger-engaging members 42 positioned on side 12', in the manner illustrated in FIG. 4 showing the attachment of hasp F. As shown, the end of rivet 41 may be passed through a corresponding opening 43 in the hasp and may be expanded to attach the hasp to the valance member V' and side 12'.

In the form illustrated in FIGS. 1-16, each latch assembly A, A' includes a latch 44 pivotally supported about one end thereof on a shaft 46 which may be integrally formed in a latch mounting plate 48. As shown in FIGS. 2 and 3, shaft 46 may be received in a recess 50 of the latch. When the latch is assembled with an attachment member or hook member 52, shaft 46 is entrapped in recess 50, thereby pivotally mounting the latch on the latch mounting plate. For this purpose, latch 44 may be formed with integral rivets 58 which are received in corresponding holes 60 in the hook member and the rivets expanded to attach the hook member to the latch. By this arrangement, the latches are supported on the mounting plates for pivotal movement about axes that are perpendicular to the edge 40 of the luggage case.

Each latch assembly A, A' includes a link member 62, which is best illustrated in FIG. 1. The link member, which may be a toggle link, is pivotally coupled to latch 44 by a pin 64 which passes through corresponding holes 66 in depending legs 56 of hook member 52 and holes 68 in one end of the toggle link. The opposite end of the toggle link is pivotally coupled to an associated slide member G, G' by a pin 70 which passes through holes 72 in the toggle link and is received in corresponding holes 74 in an adjacent end of the slide member, as shown in FIGS. 2 and 3. As will be explained shortly, the toggle links allow the positions of the slide members to be controlled by the latches and, in turn, the slide members control the positions of the latches themselves.

Figure 15:
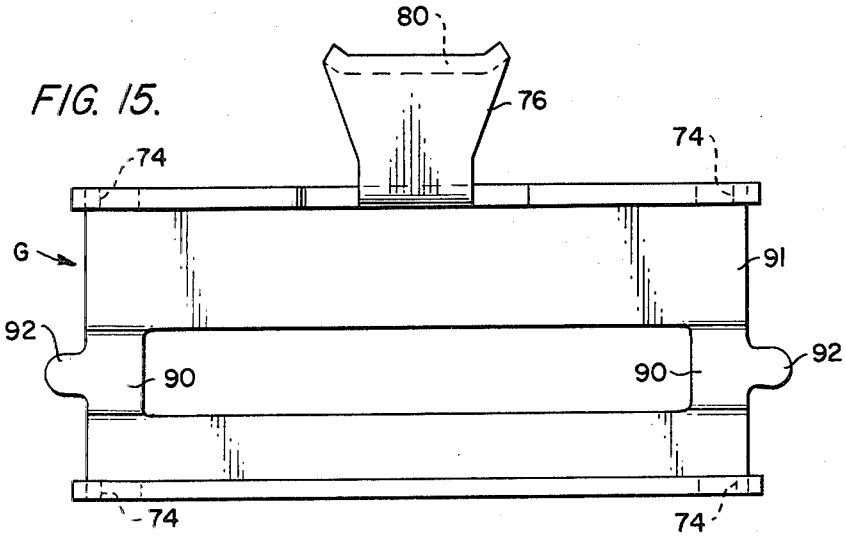
FIGS. 15 and 16 are top plan and end elevational views, respectively, of a latching slide member which may be employed in the first embodiment of the invention.
Figure 16:
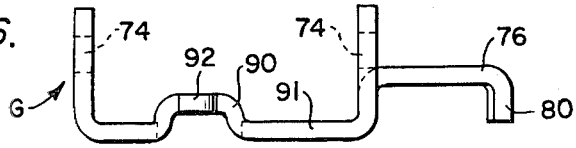

As shown in FIGS. 15 and 16, each slide member G, G' has a generally U-shaped cross section and is sized to be slideably supported within channel D between side walls 32 and 34 (FIG. 2). Projecting from one side of each slide member is a latch element 76 which passes through a corresponding opening 78 in side wall 34 of the channel, as shown in FIGS. 1, 2 and 4. Latch element 76 includes a depending portion 80 formed to engage a corresponding latch element 82 on an associated hasp F, F'. As shown in FIG. 2, latch elements 76 and 82 may be cooperatively shaped, in a well-known manner, to provide a camming action to draw the hasp toward the latch assembly when the slide member is moved to the latching position (indicated in solid lines in FIG. 2).

The longitudinal position of each slide member G, G' within channel D is controlled by the position of its associated latch 44. Referring to FIGS. 2 and 3, which illustrate the operation of latch assembly A (the operation of latch assembly A' being similar but reversed in direction), when latch 44 is moved to the closed position (solid line position of FIG. 3) toggle link 62 moves slide member G to latching position (to the right in FIGS. 2 and 3) and latch element 76 engages latch element 82 on hasp F. When the latch is opened by raising it to the phantom line position of FIG. 3, the end of toggle link 62 coupled to hook member 52 moves along an arcuate path as shown. The opposite end of the toggle link, which is coupled to the slide member, moves horizontally to the phantom line position of FIG. 3, as will be described shortly, allowing the slide member to move to unlatching position (phantom line position of FIG. 2). In the unlatching position, latch elements 76 and 82 are disengaged and latch element 76 is positioned adjacent to an opening 84 in hasp F, allowing the luggage case to be opened. In FIG. 1, slide member G moves to the right to the latching position, while slide member G' moves to the left to the latching position. Slide members G, G' and hasps F, F' are preferably identical and symmetrically shaped, as illustrated, to provide right-handed and left-handed capability without requiring specialized parts.

Slide members G, G' are confined for longitudinal movement within channel D by virtue of being confined below control members H, H'. The control members are preferably elongated planar members or rods, shaped as best illustrated in FIG. 1, supported for reciprocal movement within the channel. Each slide member is positioned below a raised central portion 86 of its associated control member, the raised portion having a longitudinally extending opening 88 therein (FIGS. 1 and 3) for receiving a corresponding raised guide portion 90 in each end of the base 91 of the slide member (FIGS. 15 and 16). A coil spring 94 is located within each longitudinal opening 88, being position on a projecting tab 92 of the slide member and an opposing projecting tab 96 of the control member (FIGS. 1, 2 and 3). When the slide members and the control members are assembled within the channel, the coil springs 94 are compressed so that each slide member and its corresponding control member are urged in opposite directions, the slide member being biased toward the unlatching position and its associated control member being biased in a direction to dispose catch elements 100 (FIGS. 3, 5 and 6) of the control member in a position to engage cooperating catch elements 102 of hook member 52. (The purpose of these catch elements will be explained shortly.) Accordingly, slide member G is biased to the left in FIGS. 1, 2 and 3, while control member H is biased to the right.

Since hardware assembly 10 is symmetrical and the construction and the operation of each half of the assembly are similar, the following description of latch assembly A and its cooperation with associated parts of the hardware assembly will suffice for both halves of the hardware assembly.

When latch 44 is in the closed position, toggle link 62 disposes slide member G in the latching position (to the solid line positons of FIGS. 2 and 3) against the bias of spring 94. As shown in FIG. 3, in the closed position of the latch, the axis of pin 64 connecting toggle link 62 to the latch lies below the axis of pin 70 connecting the toggle link to the slide member. Since slide member G is urged to the left by spring 94 and is confined for longitudinal (horizontal in FIG. 3) movement in channel D by control member H, the toggle link tends to rotate about pin 70 in a counterclockwise direction (in FIG. 3). Thus, latch 44 is urged toward the closed position. When catch elements 100, 102 are disengaged, in a manner which will be described shortly, and the latch is raised from the closed position to a position where the left end of the toggle link passes over center, i.e., the axis of pin 64 is raised above the axis of pin 70, the bias of spring 94, transmitted to the latch via slide member G and toggle link 62, forces latch 44 to pop upwardly to the open position as slide member G moves to the unlatching position. Similarly, when latch 44 is moved toward the closed position, slide member G is forced to the right (in FIGS. 2 and 3) against the bias of spring 94 to the latching position. Once the left end of the toggle link has passed over center, the bias of spring 94 drives the latch to the closed position with a snap action.

Figure 5:
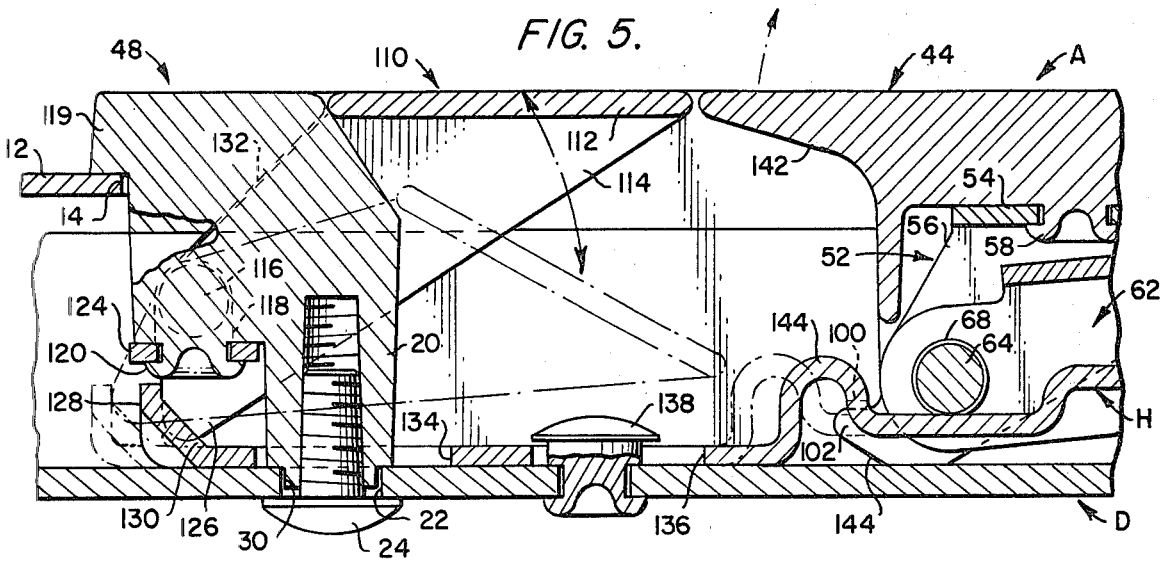
FIGS. 5 and 6 are fragmentary sectional views illustrating the cooperation between a latch, a control member and a manual actuator in accordance with the first embodiment of the invention.
Figure 6:
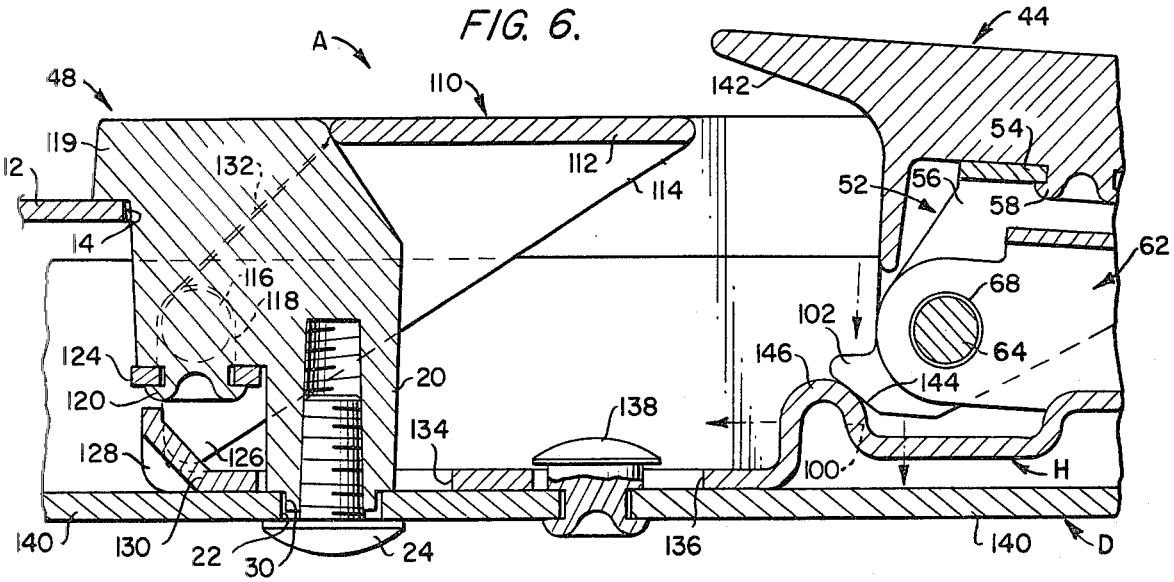

Latch assembly A also includes a manual actuator 110 pivotally supported on the latch mounting plate 48 adjacent to the end of latch 44 opposite to that about which the latch is pivoted. As shown in FIGS. 1-3, 5 and 6, manual actuator 110 includes a generally planar top portion 112 having a pair of legs 114 depending at an angle therefrom. Each leg has an inwardly projecting boss 116 received in a recess 118 in an end portion 119 of the latch mounting plate. The manual actuator may be mounted on the latch mounting plate by a rivet 120 (FIG. 3), which may be integrally formed in end portion 119, and passed through a hole 122 in a flat washer 124 (FIGS. 1 and 3). The rivet may be expanded to attach the washer to the latch mounting plate and to capture bosses 116 within recesses 118. An extended cam portion 126 of each leg abuts an adjacent up-turned end 128 of the control member (FIGS. 3, 5 and 6). Since spring 94 urges control member H to the right in FIGS. 3, 5 and 6, engagement between up-turned end 128 and cam portions 126 rotates the manual actuator in a counterclockwise direction in the figures until legs 114 engage an inclined surface 132 of end portion 119, disposing the top planar member 112 of the manual actuator in the same plane as the top of the latch mounting plate 48 (the phrase "in the same plane" or "in the plane of" being intended to permit some deviation from an exact coplanar relationship). This is the rest position of the manual actuator. Up-turned ends 128 may have a central embossed portion 130, as shown, to provide additional strength to the control member.

The cooperation between manual actuator 110 of latch assembly A and control member H will now be described, with particular reference to FIGS. 5 and 6. When the manual actuator is depressed, it pivots about bosses 116 and forces control member H to the left, as shown in phantom lines in FIG. 5. This moves catch elements 100 of the control member to the left as shown, disengaging them from catch elements 102 on the hook member and releasing the latch. Elongated slots 134 and 136 in the control member provide clearance for mounting stud 20 and a headed rivet 138 which holds the control member in engagement with the bottom 140 of channel D. Latch 44 may be formed with a finger-engaging lip 142 to facilitate raising the latch. Lip 142 is accessible only when the manual actuator is depressed and, accordingly, catch elements 100 and 102 are disengaged.

As shown in FIG. 6, when latch 44 is moved to the closed position, cam surfaces 144 of hook member 52 engage a cooperating arcuate portion 146 of the control member adjacent to catch elements 100 to provide a camming action which drives control member H to the left until catch elements 102 of the hook member pass catch elements 100. As this occurs, spring 94 drives the control member to the right, causing the catch elements to engage and the latch to be snapped to its closed position.

From the foregoing description, it is apparent how the latch assemblies A, A' are closed and held closed to retain the hasps F, F', and how the latches are opened to release the hasps. It is now in order to describe the combination lock C and how the combination lock controls the latches to determine when they can be opened.

The combination lock is preferably of the general type disclosed in U.S. Pat. No. 3,800,571, and U.S. Pat. Application Ser. No. 033,540, filed Apr. 26, 1979, both assigned to the same assignee as the present invention, the disclosures of which are incorporated by reference herein. The combination lock incorporates several improvements, however, which will become apparent from the following description.

In the form of the invention illustrated in the figures, combination lock C is mounted between handle studs B, B', as will be explained, and has a cover plate 150 which covers the combination lock dials 158. Cover plate 150 preferably has a finger-engaging tab 151 and is pivotally mounted between the handle studs by a spring 152, shaped as illustrated in FIGS. 1 and 7, which biases the cover plate closed. Spring 152 may be received in a notch 154 formed along one side of the cover plate and be attached thereto in a conventional manner, as by integrally cast rivets 153 (FIG. 8) which are expanded to capture arcuate portions 155 of the spring. Opposite ends of the spring projecting from the cover plate may be received in notches 156 of the handle studs, as shown in FIG. 7. When the cover plate is raised, the ends of the spring, which are at an angle to the notch 154, engage the underside of the handle studs causing the spring to be twisted and biasing the cover plate closed. Cover plate 150 shields the combination lock dials and prevents casual observation of the dial numbers if the combination lock is left on-combination.

Figure 11:
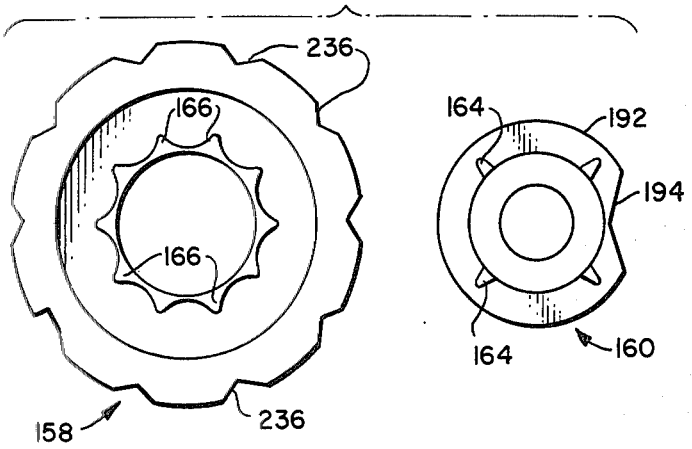
FIGS. 11 and 12 are elevational views of a dial and a sleeve of a combination lock which may be employed in the invention.
Figure 12:
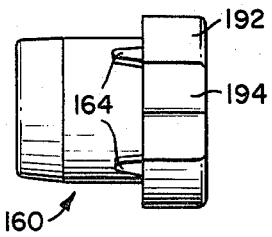

The combination lock comprises a plurality of dials 158 and corresponding sleeves 160, shown in detail in FIGS. 11 and 12. As shown in FIGS. 7 and 8, sleeves 160 are supported on a shaft 162, each sleeve having teeth 164 which are received in recesses 166 of the dials, so that each dial is normally coupled to its associated sleeve for rotation therewith. The ends of shaft 162 may fit within cut-outs 168 (FIGS. 7 and 8) in opposite sides of a generally U-shaped frame 170 (FIGS. 1 and 8). A faceplate 172, having a plurality of slots 183 through which the dials extend, is positioned on frame 170 and has downwardly projecting tabs 174 (FIG. 8) which fit into cut-outs 168 of the frame to trap the ends of shaft 162 therein. Frame 170 abuts the underside of faceplate 172 and may be attached thereto by centrally located tabs 175 in the faceplate which are bent around the ends of frame 170 to hold the frame in engagement with the face plate (see FIG. 8 which shows the left tab 175 in phantom lines in its unbent position).

Figure 10:
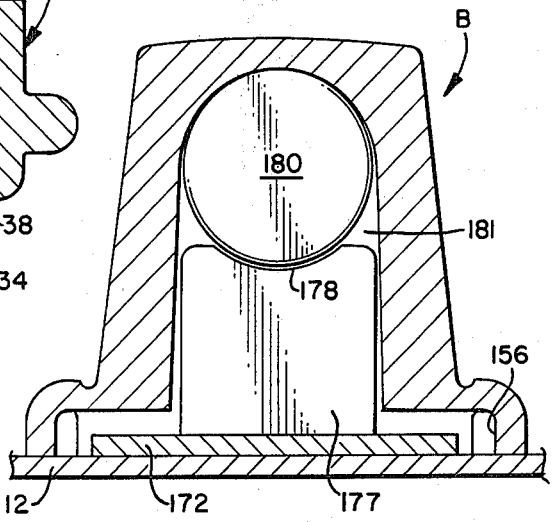
FIG. 10 is a transverse sectional view taken approximately along the line 10—10 of FIG. 8.

As shown in FIGS. 1 and 8, faceplate 172 may have holes 176 in its opposite ends which pass mounting studs 26 of handle studs B, B'. As also shown in FIG. 8, the combination lock fits within cut-out 18 in the side 12 of the case, with the bottom of frame 170 positioned on the bottom 140 of channel D. Opposite end portions 177 of faceplate 172 are up-turned and provide arcuate bearing surfaces 178 for supporting mounting elements 180 of handle E which are received in openings 181 of the handle studs (FIGS. 1, 8 and 10). This arrangement provides a convenient way for pivotally supporting handle E on the handle studs, while at the same time mounting the combination lock between the handle studs. The up-turned portions could be part of frame 170, and the term "faceplate" is intended to embrace frame parts also.

A coil spring 184 on one end of the shaft urges sleeves 160 into end-to-end abutting relationship with each other against a collar 186 formed on the shaft, and couples each sleeve to its associated dial. A shift lever 188 located on the shaft between collar 186 and frame 170 has an arm which extends through openings 189 in the frame and 190 in channel D (FIG. 8). Shift lever 188 is used to disengage the dials from the sleeves for changing the combination, as is well known.

As shown in FIG. 12, each sleeve 160 has a circular flange 192 with a V-shaped notch portion 194. The orientation of the notches 194 relative to a bolt 196 determines whether the combination lock is locked or unlocked.

Figure 13:
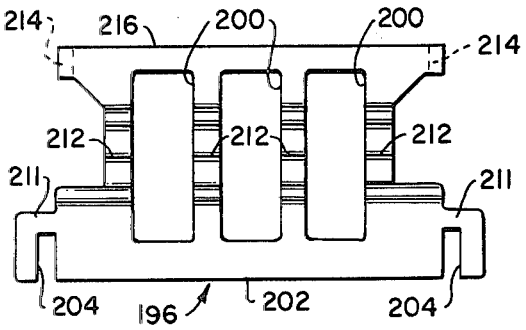
FIG. 13 is a plan view of a bolt employed in the combination lock of FIG. 7.

As shown in FIGS. 7–9 and 13, bolt 196 has a plurality of transverse slots 200 through which dials 158 extend. As shown in FIGS. 7 and 9, bolt 196 also has slots 204 on opposite ends of side 202, which are positioned on upstanding projections 206 formed in the ends of the frame 170. A coil compression spring 208 is located on each projection 206 between the upper surface of the bolt and faceplate 172, as shown in FIGS. 7 and 9. Each projection 206 has a ledge 210 (FIG. 9) sloping slightly downwardly from horizontal (preferably at an angle of about 10 degrees). Bolt 196 is pivotally supported on ledges 210 by the portion 211 of the bolt at the base of each slot 204 (FIG. 13). The downward force of each compression spring 208 on the bolt leftwardly (in FIG. 9) of its pivot point urges the bolt to a horizontal position, as illustrated in solid lines in FIG. 9. As will be explained, this is the unlocked position of the combination lock.

As shown in FIGS. 9 and 13, the bolt may have a central ridge portion 212 which is shaped to cooperate with notches 194 of the sleeves. When the dials 158 are all turned on-combination, the notches 194 of their corresponding sleeves are aligned with the ridge portion 212 of the bolt, allowing the ridge portion to be received in the notches and allowing the bolt to assume a horizontal (unlocked) position, as shown in FIG. 9. When any dial is turned off-combination, its associated sleeve is rotated so that flange 192 contacts ridge portion 212, pivoting the bolt downwardly to the phantom line position in FIG. 9. This is the locked position of the bolt.

As also shown in FIG. 13, the bolt is formed with a pair of downward projections 214 (FIGS. 8, 9 and 13) at each end of its side 216. When the bolt is in locked position, projections 214 extend through corresponding openings 217 in frame 170 (FIG. 7) and into corresponding openings 218 in the bottom 140 of channel D. As shown in FIG. 1, a pair of notches 220 are formed in the end of control members H, H' which is adjacent to combination lock C, and the ends of the control members are positioned beneath raised portions 222 in opposite ends of the frame (FIG. 8). The control members, biased toward each other by springs 94, are urged against tangs 224 formed in channel D, which extend through slots 226 in the control members, as shown in FIGS. 1 and 8. In this position, one notch 220 of each control member is positioned adjacent to a corresponding opening 218 in the channel so that it may receive one of the projections 214 of the bolt (FIG. 9). Thus, when the bolt is in locked position, engagement between projections 214 and notches 220 prevents movement of the control members by the manual actuators 110, thereby preventing disengagement of catch elements 100 and 102 and locking the latches in their closed position. Although the control members are formed with two notches 220 on opposite sides, only one notch is actually used. The second notch renders the control member symmetrical, providing right-handed or left-handed capability without requiring separate parts.

Figure 14:
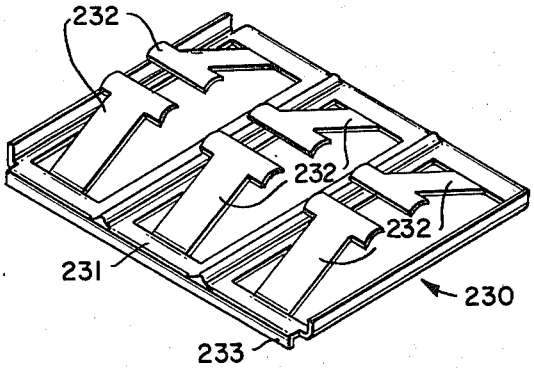
FIG. 14 is a perspective view of a dial spring of the combination lock of FIG. 7.

The combination lock also includes a dial spring 230, best illustrated in FIG. 14. The dial spring, preferably of spring-tempered phosphorous bronze, comprises a base 231 having a plurality of arms 232 struck upwardly from the base. Depending lips 233 on each side of the base fit on opposite sides of the bottom of frame 170 (FIG. 9) to position the dial spring within the combination lock. Each dial has a series of equally spaced indexing notches 236 around its periphery which receive the ends of the dial spring arms for holding the dials in predetermined rotational positions, at which successive numbers or indicia 238 on the dials may be centrally displayed through slots 173 in the face plate.

The hardware assembly of the invention may be readily adjusted to accommodate different size luggage cases, by adjusting the lengths of the control members H, H' and the channel D. Spacer plates 240 (FIG. 1), sized to fit between the handle studs and the latch mounting plates may be employed to adjust the length of the assembly. As shown in FIG. 1, the spacer plates preferably have tabs 242 extending from opposite ends thereof, which are received in recesses 244 in the ends of the latch mounting plates and the handle studs.

FIGS. 17–23 illustrate a second embodiment of the invention. The second embodiment, which is the more preferred construction of a hardware assembly in accordance with the invention, is similar in many respects to the first embodiment. Accordingly, the following description is limited to that necessary to point out the differences in construction and operation between the two embodiments.

Figure 17:
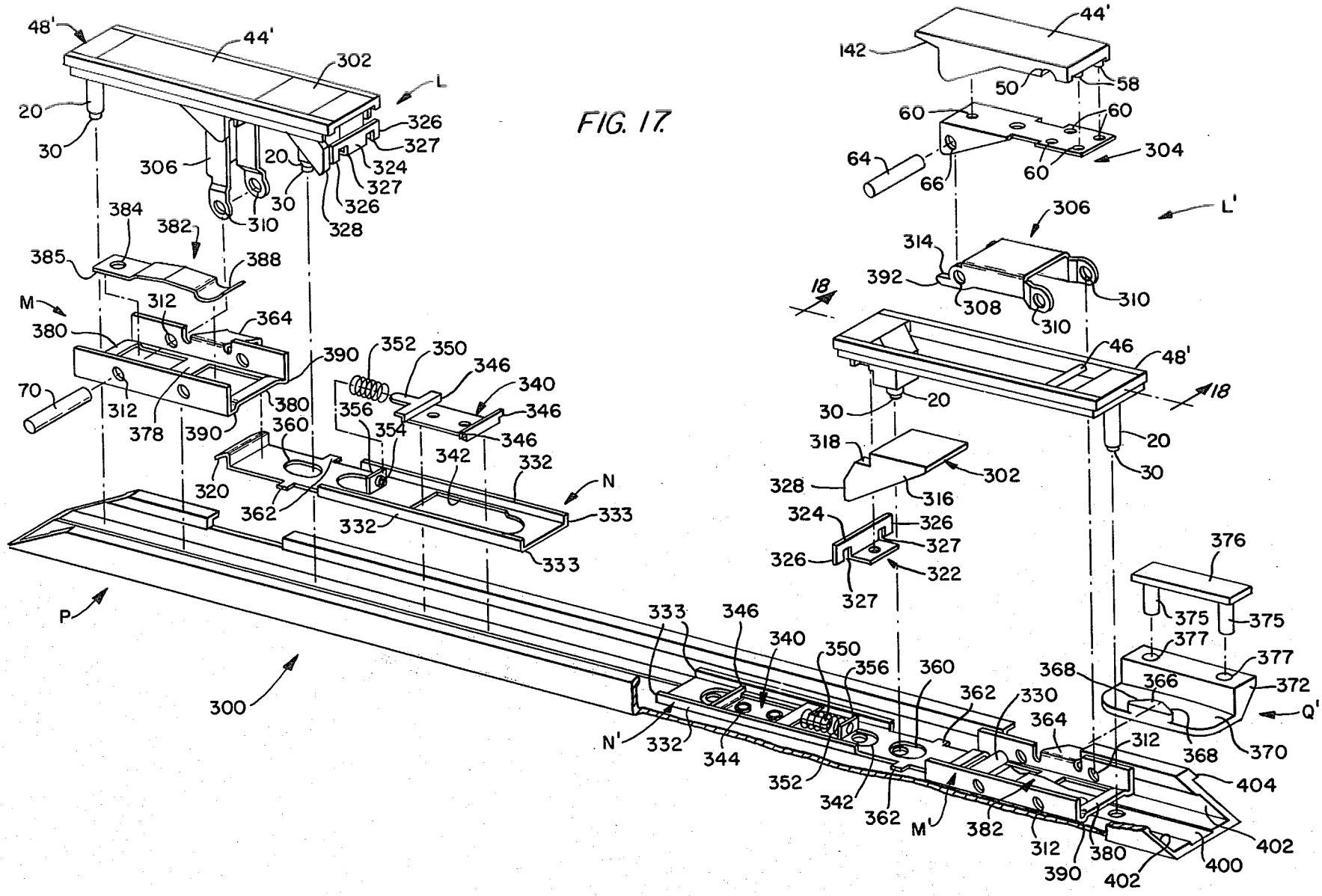
FIG. 17 is an exploded perspective view, partially broken away, illustrating a hardware assembly in accordance with a second embodiment of the invention.

As shown in FIG. 17, a hardware assembly 300 in accordance with a second embodiment of the invention comprises latch assemblies L, L' having associated latching slide members M, M', and associated control members N, N', the slide members and the control members being slideably disposed within a generally U-shaped channel P. As will be explained, movement of the control members in the channel is effective to control the operation of the latch assemblies, and a combination lock C' (FIG. 20) may be included to control the movement of the control members. The slide members are formed to engage associated hasps (one such hasp Q' being illustrated in FIG. 17) attached to a cooperable part of the luggage case. In the following description of the second embodiment, parts which are similar to those employed in the first embodiment bear the same reference designations as used in the description of the first embodiment. In addition, for clarity, certain components of the hardware assembly 300 have been omitted in FIG. 17, e.g., the combination lock C' (shown in FIG. 20), handle studs and a handle. It is understood, however, that, except as described below, components similar to those employed in the first embodiment of the invention may also be employed in the second embodiment of the invention.

Generally, one difference between the first and second embodiments is that the latch assemblies L, L' of the second embodiment have been rotated 180° from the positions of the latch assemblies A, A' of the first embodiment. Accordingly, the manual actuators 302 of the latch assemblies L, L', instead of being positioned near the outer ends of the hardware assembly as in the first embodiment, are located toward the center of the hardware assembly adjacent to the handle studs (not shown in FIG. 17). Thus, to open the latches, the manual actuators are adapted to be depressed by the thumbs of the user, and the thumbs used to raise the latches. In the first embodiment, the latch assemblies are adapted to be operated by a finger of the user, such as an index finger. Since hardware assembly 300 is symmetrical and the components of the two halves of the hardware assembly are preferably identical and having a similar operation (only reversed in direction) a description of one half of the hardware assembly will suffice for a description of both halves. Moreover, corresponding components of the two halves of the hardware assembly bear the same reference designators.

As shown in FIG. 17, latch assembly L' generally comprises a latch 44' pivotally mounted on a shaft 46 integrally formed in a latch mounting plate 48', the latch mounting plate having mounting studs 20 for attaching the mounting plate to the channel P. An attachment member 304 is attached to the underside of the latch by rivets 58 on the underside of the latch which are received in holes 60 of the attachment member. This entraps shaft 46 in recess 50 of the latch to pivotally support the latch on the shaft in a manner similar to that described for the first embodiment. A link member 306 has one end thereof pivotally connected to the attachment member by means of a pin 64 extending through holes 66 in the attachment member and corresponding holes 308 in the link member. The opposite end of link member 306 is connected to the slide member by a second pin 70 which extends through holes 310 in the link member and holes 312 in the slide member. Pin 70 may be a rivet having its ends expanded (not illustrated) for attaching the pin to the slide member. In contrast to the first embodiment where catch elements 102 were formed on the depending legs 56 of hook (attachment) member 52, in the second embodiment catch elements 314 are formed on the link member 306. The attachment members are preferably formed by die casting, whereas the link members are preferably stamped from steel.

Thus, forming the catch elements on the link member is preferable for imparting greater strength to them.

Figure 18:
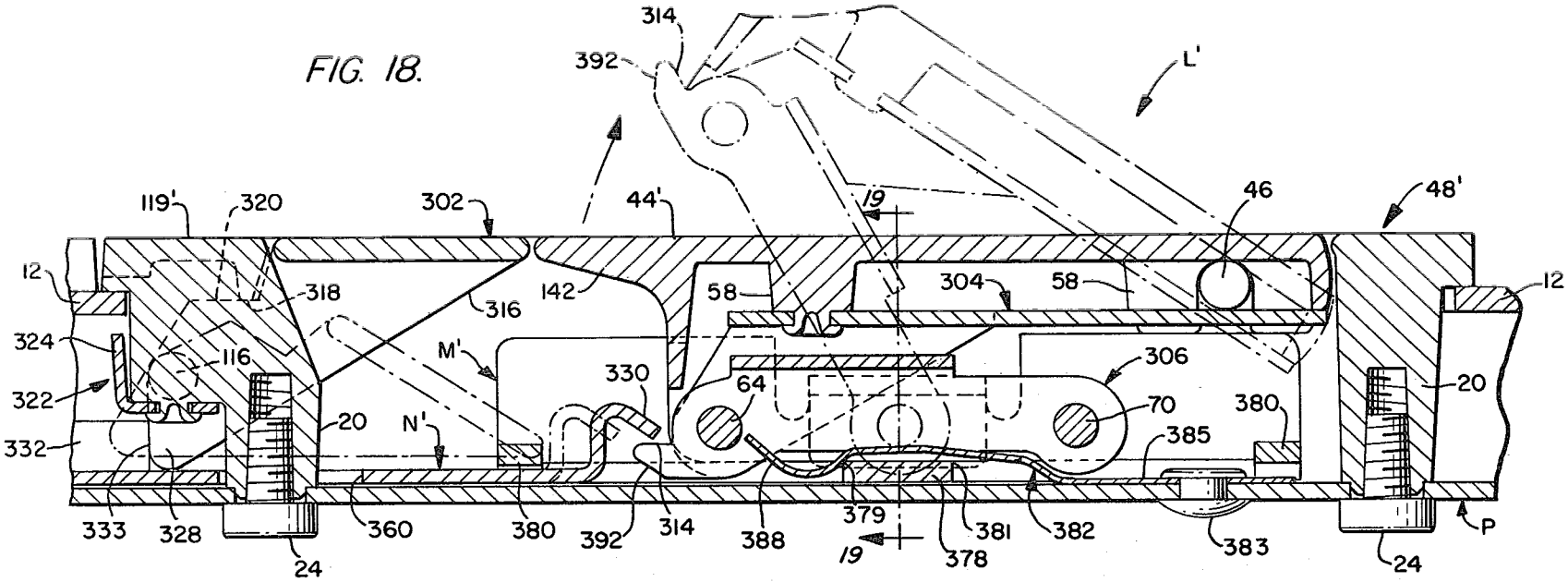
FIG. 18 is a longitudinal sectional view taken approximately along the line 18—18 of FIG. 17.

Manual actuator 302 may be pivotally supported on the latch mounting plate by bosses 116 (FIG. 18) received in recesses in the end portion 119' of the latch mounting plate, as described for the first embodiment. As shown in FIGS. 17 and 18, the rear portion of the depending legs 316 of the manual actuator is formed with a flat, squared-off surface 318 (horizontal in the figures) which abuts a corresponding surface 320 in the end portion 119' of the latch mounting plate to provide a positive stop for holding the manual actuator in its rest position. A mounting washer 322 (FIGS. 17 and 18) for attaching the manual actuator to the latch mounting plate is preferably formed with an angled portion 324 having depending projections 326 which are positioned to engage the cam portions 328 of the depending legs 316 of the manual actuator when the manual actuator is moved to release position. Notches 327 in angled portion 324 adjacent to projections 326 facilitate formation of washer 322. Engagement between projections 326 and cam portions 328 of the manual actuator serves as a positive stop to limit the movement of the manual actuator toward its release position.

As best illustrated in FIG. 17, each control member N, N' comprises a generally flat, elongated member shaped as illustrated. A hook portion 330 is formed on one end of each control member for engaging catch elements 314 on an associated link member 306. A portion of the control member may be generally U-shaped, the sides 332 of the control member being bent upwardly as shown. This serves to strengthen the control member, and the sides 332 cooperate with the combination lock, in a manner which will be explained, to block movement of the control member in the channel. A bracket 340, shaped as best illustrated in FIG. 17, may be positioned within an elongated cutout 342 in the control member and attached to the bottom of the channel, as by rivets 344. Each end of the bracket may be bent upwardly as shown, and may be formed with projections 346 which keep the bottom of the control member in engagement with the bottom of the channel. One end of the bracket preferably has a projection 350 on which a coil spring 352 is located. The opposite end of the coil spring may be located on a protrusion 345 formed on a projection 356 on the control member, as illustrated in FIG. 17. The coil spring biases the control member in a direction to cause the hook portion 330 of the control member to engage the catch elements 314 of the link member, in the manner illustrated in FIG. 18.

Figure 20:
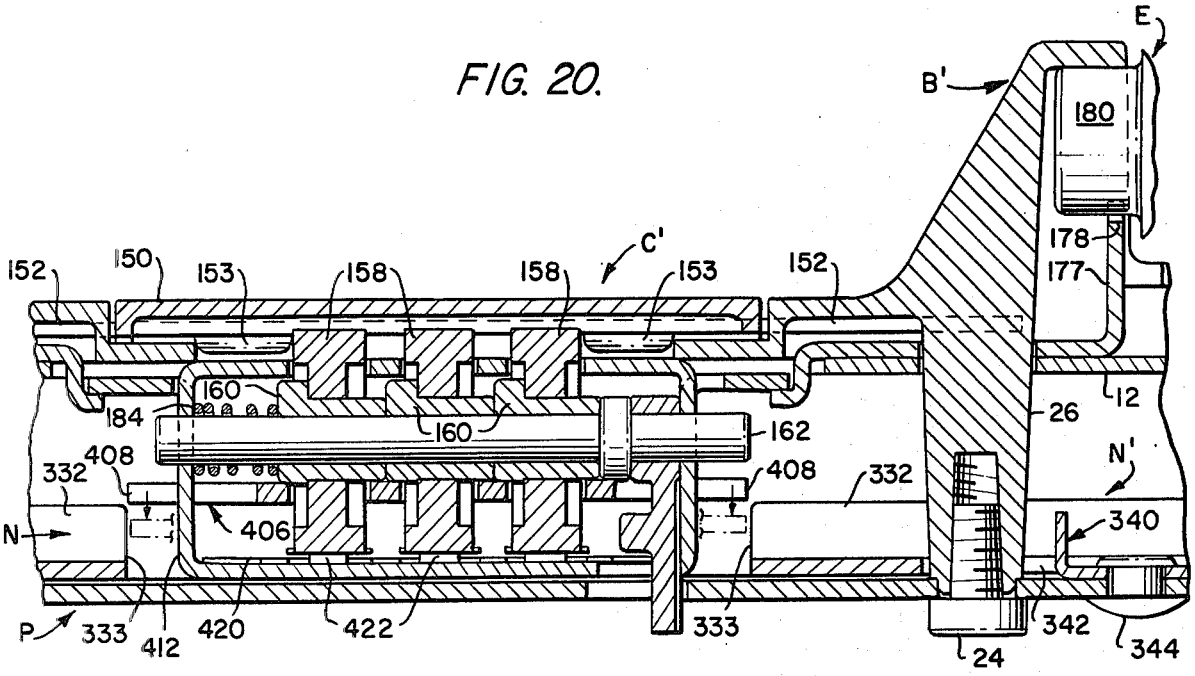
FIG. 20 is a longitudinal sectional view similar to FIG. 8 of a combination lock which may be employed in the second embodiment of the invention.

As shown in FIG. 20, a mounting stud 26 of a handle stud B' passes through cut-out 342 in the control member for attaching the handle stud to the channel P. Another elongated cut-out 360 (FIG. 17) formed in the control member N' passes one mounting stud 20 of the latch mounting plate (see FIG. 18) for attaching the latch mounting plate to the channel. As illustrated, cut-outs 342 and 360 are sized to permit sufficient movement of the control member to disengage hook portion 330 from catch elements 314, as will be explained. Outwardly projecting tabs 362 (FIG. 17) may be formed on the control member adjacent to cut-out 360, for a purpose which will be explained shortly.

Figure 19:
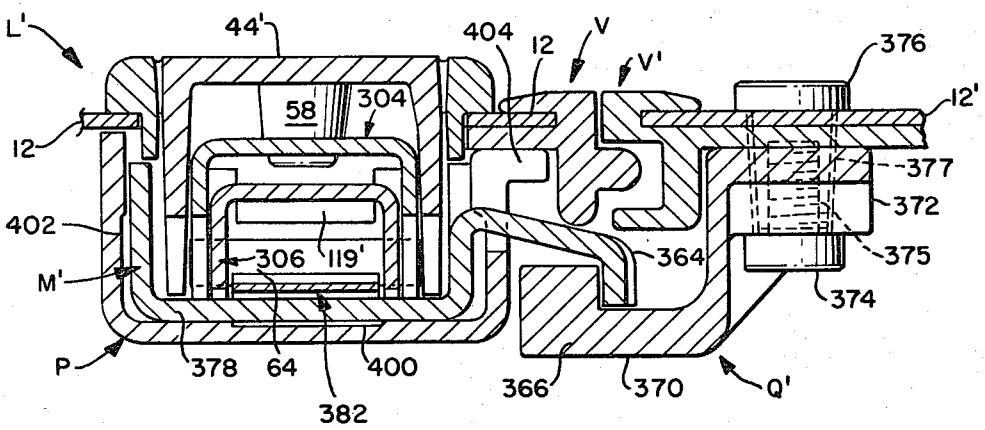
FIG. 19 is a transverse sectional view taken approximately along the line 19—19 of FIG. 18.

As shown in FIGS. 17 and 19, slide member M' may be a generally U-shaped member having a projecting latch element 364 formed for engagement with a cooperable latch element 366 on hasp Q'. Latch element 366 on the hasp may be generally wedge-shaped, as illustrated in FIG. 17, having cam surfaces 368 which cooperate with latch element 364 for drawing the hasp toward the latch assembly when the latch is closed. Latch element 366 may be formed on a ledge 370 projecting from a base portion 372 of the hasp, the base portion being formed for attachment to a valance member V' (FIG. 19) attached to side 12' of the luggage case. This spaces the latch element 366 from the valance member, as shown, to facilitate engagement of the latch element 366 by latch element 364.

As shown in FIG. 18, the hasp may be attached to the valance member by means of threaded fasteners 374 threaded into mounting studs 375 depending from a finger-engaging member 376. The mounting studs are adapted to extend through holes in the valance member and the side 12' of the case, and be received in holes 377 in the base portion of the hasp. As opposed to the hasps of the first embodiment, which are preferably stamped steel, hasp Q' is preferably a die-cast member, its design lending itself to this type of construction.

The bottom of slide member M' comprises a center bar 378 and two end bars 380 at opposite ends of the slide member, the spaces between the end bars 380 and the center bar 378 being open and the end bars being raised slightly, as illustrated. A clip 382 preferably formed from a generally rectangular piece of resilient material, such as spring steel, with a shape as illustrated in FIGS. 17 and 18, may be attached to the bottom of channel P by means of a rivet 383 passed through a hole 384 in one end 385 of the clip. As shown in FIG. 18, end 385 of the clip may be substantially flat for engagement with the bottom of channel P. The flat end of the clip is sized to be positioned in one of the openings between the center bar 378 and an end bar 380 of the slide member. The opposite end 388 of the clip may be curved, as illustrated in FIG. 18, so that it engages the center bar 378 of the slide member to hold the slide member in engagement with the bottom of the channel. The curved portion also serves as a detent to atlernately hold the slide member in its latching and its unlatching positions. In the position shown in solid lines in FIG. 18, the slide member is in latching position and the curved position of the clip engages the left edge 379 of center bar 378, as illustrated. When the latch 44' is moved to open position (the phantom line position illustrated in FIG. 18) the slide member is moved to the left to unlatching position, at which the curved portion of the clip engages the opposite edge 381 of the center bar.

Channel P, which slideably supports the control members and the slide members, may be formed with a longitudinally extending shallow groove 400 in its bottom portion and longitudinally extending side grooves 402 in its sides (see FIGS. 17 and 19). This reduces the surface contact between the channel and the control members and the slide members, reducing friction. Side grooves 402 also serve as clearances for the expanded ends of pin 70, by means of which the link member 306 is coupled to the slide member. The side of the channel adjacent to valance member V may be formed with a lip 404 which engages the underside of the valance member V (see FIG. 19) when the channel is attached to the luggage case. This allows the width of the channel and the width of the slide members to be reduced somewhat and provides a more compact assembly. Moreover, as illustrated in FIG. 19, latch element 366 of hasp Q' extends beyond the edge of valance member V' and is positioned below valance member V when the parts 12, 12' of the luggage case are brought together, minimizing the portion of latch element 364 which projects beyond the edge of valance member V.

Referring particularly to FIG. 18, the operation of the latching mechanism of the second embodiment of the invention will now be described. The solid lines in FIG. 18 represent the relationship of the various components when the manual actuator 302 is in its rest position and latch 44' is in its closed position. Engagement between the catch elements 314 of link member 306 and the hook portion 330 of control member N' (the hook portion 330 constituting cooperable catch elements) serves to hold latch 44' in its closed position. Control member N' is biased to the solid line position illustrated in the figure by coil spring 352 (FIG. 17), which biases the control member outwardly from the center of the hardware assembly. The outward movement of the control member is limited by engagement between the edge of cut-out 342 in the control member and mounting stud 26 of handle stud B' (see FIG. 20), and by the engagement between the ends 333 of the sides 332 of the control member and the cam portions 328 of the manual actuator. The control member is urged by spring 352 into engagement with cam portions 328 of the manual actuator, tending to rotate the manual actuator counterclockwise in FIG. 18. Engagement between the squared-off surfaces 318 of the manual actuator and 320 of the end portion 119' of the latch mounting plate holds the manual actuator in its rest position.

When the manual actuator 302 is moved to the release position (depressed to the phantom line position illustrated in FIG. 18), the engagement between cam portions 128 of the manual actuator and the ends 333 of the control member moves the control member against the bias of spring 352 (to the left in FIG. 18) toward the center of the hardware assembly. This moves hook portion 330 to the left in FIG. 18 to the phantom line position illustrated, at which the hook portion is moved out of engagement with catch elements 314. Latch 44' may then be raised to open position (the phantom line position illustrated in the figure). When the latch is moved to open position, slide member M' is moved to the left, disengaging latch elements 364 and 366 so that the case may be opened.

When latch 44' is initially raised toward the open position and thumb pressure on manual actuator 302 ceases, the bias of spring 352 forces control member N' back to the solid line position illustrated in FIG. 18, returning the manual actuator to the rest position. As the latch continues to be raised toward its fully open position and slide member M' continues to move leftwardly to unlatching position, ends 390 of the slide member (FIG. 17) engage projecting tabs 362 on the control member. This moves the control member toward the center of the hardware assembly so that the slide member may be moved fully to unlatching position.

When the latch 44' is moved to closed position, cam surfaces 392 on the link member 306 adjacent to catch elements 314 engage hook portion 330 of the control member to move the control member to the left in FIG. 18 allowing the latch to be closed. As the latch reaches its closed position, spring 352 forces the control member back to the solid line position to engage the catch elements and the hook portion, imparting a snap-action to the latch.

Latch assemblies L, L' may be controlled by a combination lock C', illustrated in FIG. 20. In most respects, combination lock C' is similar to combination lock C of the first embodiment. However, combination lock C' employs a different blocking arrangement for the control members N, N', as will now be described.

Figure 21:
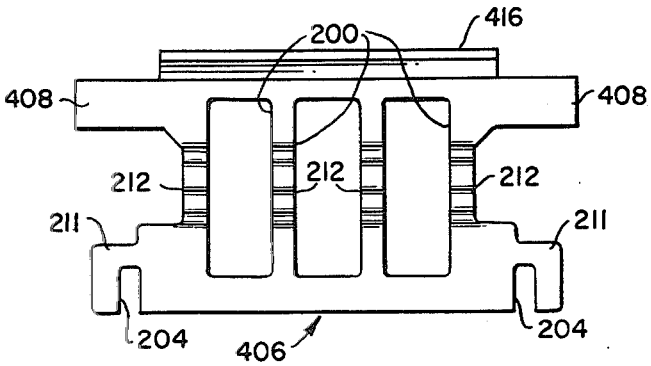
FIGS. 21 and 22 are a plan view and an end view, respectively, of a bolt employed in the combination lock of FIG. 20.
Figure 22:
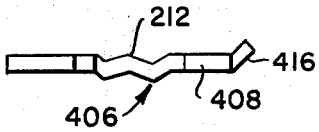

As illustrated in FIGS. 21 and 22, bolt 406 of combination lock C' has projections 408 which extend longitudinally from opposite ends of the bolt, and which lie substantially in the plane of the bolt. Projections 408 extend beyond the sides 410 of frame 412 of the combination lock, as shown in FIG. 20. When the combination lock is on combination, the bolt is in the solid line position illustrated in FIG. 20. When any dial is turned off combination, the bolt is pivoted downwardly to the phantom line position in the same manner as previously described for combination lock C of the first embodiment. At this position, projections 408 are located adjacent to the ends 333 of the control members. This blocks the movement of the control members by the manual actuators toward the center of the hardware assembly, thereby preventing operation of the latch assemblies.

As shown in FIGS. 21 and 22, the side of the bolt adjacent to projections 408 may be provided with an angled portion 416. This serves as a strengthening member for the bolt to prevent it from being damaged due to excessive pressure on the manual actuators.

Figure 23:
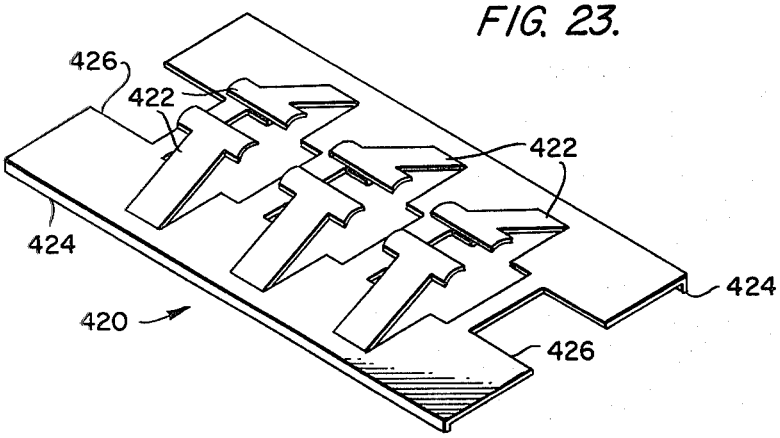
FIG. 23 is a perspective view of a dial spring employed in the combination lock of FIG. 20.

Since the control members do not slide beneath the frame of the combination lock, as they do in the first embodiment, frame 412 of combination lock C' may engage the bottom of channel P over its entire length, as illustrated in FIG. 20. Combination lock C' also employs a slightly different dial spring 420, as illustrated in FIG. 23. Dial spring arms 422 are lanced from a generally rectangular piece of resilient material, such as spring tempered phosphorous bronze. The dial spring may be provided with lips 424 along opposite sides, as shown, for engaging the sides of frame 412 to locate the dial spring on the frame. Notches 426 formed in each end of the dial spring provide clearance for shift lever 188, two such notches being provided so that the spring may be symmetrical.

As is apparent from the foregoing, the latching assembly of the invention provides significant advantages over prior art pivoting latch mechanisms and avoids the disadvantages of these mechanisms. The latches do not pop open when the manual actuators are operated, as may occur with prior mechanisms. Catch elements 100 and 102 of the first embodiment, and catch elements 314 and 330 of the second embodiment, serve as safety catches which must be disengaged in order to open the latches. However, operation of the manual actuators and disengagement of the catch elements do not, alone, result in the latches moving to open position. Accordingly, the latches are less susceptible to opening when the case is jarred or dropped.

In the forms illustrated, the hardware assembly of the invention may be mounted directly on a side wall of the luggage case adjacent to a valance member, the side wall being provided with appropriate openings for receiving the various parts. The hardware assembly of the invention is particularly adapted for use with luggage cases having sturdy side walls, e.g., metal cases. However, the hardware assembly may also be formed entirely within a valance member and attached to a luggage case as a unit.

While preferred embodiments of the invention have been shown and described, it will be apparent to those skilled in the art that changes can be made without departing from the principles and spirit of the invention, the scope of which is defined in the appended claims.

What is claimed is:

1. A hardware assembly for luggage and the like comprising a latch, means for pivotally supporting the latch on a first part of a luggage case for movement between open and closed positions; control means supported for movement along the case, the control means having catch elements which are engageable with cooperating catch elements associated with the latch to hold the latch in the closed position; manual actuator means; and means for pivotally supporting the manual actuator means on the case adjacent to the latch, the manual actuator means being movable between a rest position and a release position, and being engageable with the control means for moving the control means in a direction to disengage the catch elements and release the latch for movement to the open position when the manual actuator means is moved to the release position.

2. The assembly of claim 1, wherein the latch is pivotally supported near one end thereof about an axis perpendicular to an edge of the case, and the manual actuator means is pivotally supported about an axis parallel to the first-mentioned axis near the opposite end of the latch.

3. The assembly of claim 2, wherein the means for pivotally supporting the latch and the means for pivotally supporting the manual actuator means comprises a latch mounting plate formed for attachment to the first part of the luggage case adjacent to the edge of the case.

4. The assembly of claim 3 further comprising an elongated channel, adapted to extend parallel to said edge on the inside of the case, the latch mounting plate being attached to the channel, and the channel supporting the control means for reciprocating movement therein.

5. The assembly of claim 4 further comprising spring means for biasing the control means into engagement with the manual actuator means and in a direction to urge the manual actuator means to the rest position and to engage said catch elements.

6. The assembly of claim 5, wherein the top of the manual actuator means is in the plane of the mounting plate when the manual actuator means is in the rest position and the top is pivoted out of said plane when the manual actuator means is in the release position.

7. The assembly of claim 6, wherein the mounting plate includes an abutment surface for holding the top of the manual actuator means in the plane of the mounting plate when the manual actuator means is in the rest position.

8. The assembly of claim 6, wherein the manual actuator means is adapted to pivot into the case toward the release position, and wherein the latch has a finger-engaging projection adjacent to the manual actuator means which is adapted to be engaged when the manual actuator means is in the release position for moving the latch to the open position.

9. The assembly of claim 5, wherein the cooperating catch elements and the control means have cooperating cam surfaces for moving the control means in said first-mentioned direction when the latch is moved to the closed position, the spring means being operable to move the control means in the opposite direction to said first-mentioned direction to a position to engage said catch elements when the latch is in the closed position, thereby providing a snap-action to the latch.

10. The assembly of claim 1 comprising a slide member movable along an edge of the case between latching and unlatching positions and having a latch element formed for engagement with a cooperating latch element on a second part of the luggage case that moves toward the first part of the case when the parts are brought together, and means comprising a link member for coupling the slide member to the latch, the slide member being movable with the latch and being disposed in the latching position when the latch is in the closed position and being movable to the unlatching position when the latch is moved to the open position.

11. The assembly of claim 10, wherein one end of the link member is pivotally connected to the slide member, and the opposite end of the link member is pivotally connected to a member attached to the latch.

12. The assembly of claim 11 further comprising spring means for biasing the control means in a direction to engage said catch elements.

13. The assembly of claim 12, wherein the catch elements associated with the latch comprise projections on the link member, and the catch elements on the control means comprise a hook portion formed for engagement with the projections when the latch is in the closed position.

14. The assembly of claim 13 comprising a channel adapted to be attached to the case for supporting the control means and the slide member for reciprocating movement therein.

15. The assembly of claim 14 comprising a resilient clip attached to the channel, the clip being formed to engage a portion of the slide member for holding the slide member in engagement with the channel.

16. The assembly of claim 15, wherein the clip is shaped to form a detent for the slide member to alternately hold the slide member in said latching and unlatching positions.

17. The assembly of claim 15 comprising a bracket attached to the channel, the bracket having means for holding the control means in sliding engagment with the channel, and the bracket and the control means having means for supporting the spring means therebetween.

18. The assembly of claim 12, wherein the spring means is positioned between the slide member and the control means for biasing the slide member and the control means in opposite directions, the slide member being biased toward the unlatching position.

19. The assembly of claim 18, wherein the link member comprises a toggle link, the toggle link being operable to hold the latch in the closed position until the latch moves the toggle link to a position over center, at which position the toggle link is operable to transmit the bias of the spring means to the latch in a direction to urge the latch toward the open position.

20. The assembly of claim 19, wherein the toggle link is operable to transmit the bias of the spring means to the latch in a direction to snap the latch to the closed position when the latch is moved from the open position past the over-center position.

21. The assembly of claim 10, wherein the latch element on the slide member and the cooperable latch element on the second part of the case comprise cam means for drawing the parts of the case together when the latch elements are engaged and the latch is moved to the closed position.

22. The assembly of claim 1 comprising lock means, which, when locked, blocks the movement of the control means in the direction required for releasing the latch and which, when unlocked, permits such movement.

23. The assembly of claim 22, wherein the lock means comprises a combination lock having bolt means for blocking and unblocking the movement of the control means.

24. A hardware assembly for luggage and the like comprising a latch mounting plate formed for attachment to a first part of a luggage case, a latch pivotally supported near one end thereof on the latch mounting plate for movement between open and closed positions, manual actuator means pivotally supported on the latch mounting plate near the opposite end of the latch for movement between a rest position and a release position, and means engageable with catch means associated with the latch for holding the latch in the closed position, movement of the manual actuator means to the release position being effective to disengage the catch means and the holding means to allow the latch to be moved to the open position.

25. The assembly of claim 24, wherein the latch mounting plate includes first means for pivotally supporting the latch about an axis perpendicular to an edge of the case and second means for pivotally supporting the manual actuator means about an axis parallel to the first-mentioned axis.

26. The assembly of claim 25 comprising an attachment member attached to the underside of the latch for entrapping the first means in a recess in the latch, and wherein the second means includes recesses formed in the latch mounting plate for receiving bosses attached to the manual actuator means.

27. The assembly of claim 25, wherein the latch is in the plane of the latch mounting plate when the latch is in the closed position and is pivoted in a first direction out of said plane when in the open position, and wherein the manual actuator means is in the plane of the latch mounting plate when the manual actuator means is in the rest position and is pivoted in an opposite direction to the said first direction out of said plane when moved to the release position.

28. The assembly of claim 25 further comprising a slide member movable between latching and unlatching positions and having a latch element formed for engagement with a cooperating latch element on a second part of the luggage case that moves toward the first part of the case when the parts are brought together, and means comprising a link member for coupling the slide member to the latch, the slide member being movable between said latching and unlatching positions when the latch is moved between said closed and open positions, respectively.

29. The assembly of claim 28, wherein one end of the link member is pivotally coupled to the slide member and the opposite end of the link member is pivotally coupled to a member attached to the latch.

30. The assembly of claim 28, wherein the slide member is supported for movement within a channel adapted yo be attached to the first part of the luggage case.

31. The assembly of claim 30, wherein the channel has resilient clip therein for engaging the slide member to hold the slide member in engagement with the channel and the clip is formed to serve as a detent for the slide member to alternately hold the slide member in said latching and unlatching positions.

32. The assembly of claim 30, wherein the means for holding the latch in closed position comprises a control rod slideably disposed within the channel, the channel having a bracket therein for holding the control rod in engagement with the channel, the bracket and the control rod having cooperable means for supporting a spring therebetween for biasing the control rod into engagement with the latch.

33. The assembly of claim 24 further comprising lock means cooperable with the holding means for preventing movement of the latch to the open position.

34. A hardware assembly for luggage cases and the like comprising a pair of handle studs adapted to be mounted on a luggage case adjacent to an edge thereof, each handle stud having an open end for receiving a mounting element of a handle, and a combination lock supported between the handle studs, the combination lock having a faceplate with up-turned end portions positioned within each handle stud adjacent to the open ends, the up-turned end portions providing bearing surfaces for the mounting elements of the handle received in the open ends.

35. The assembly of claim 34 comprising a cover member pivotally mounted between the handle studs and spring means for biasing the cover member toward a closed position at which the cover member covers the combination lock.

36. The assembly of claim 35 comprising a pair of spaced latches adapted to be mounted on the case, the latches having an open position and a closed position, and control means adapted to be supported on the case and being coupled to the latches and to the combination lock, the control means having means for preventing movement of the latches to open position when the combination lock is off combination.

37. In a hardware assembly for luggage and the like, a combination lock comprising a frame, a faceplate attached to the frame, the faceplate having a plurality of slots therein, a shaft supported on the frame, a plurality of dials rotatably supported on the shaft and extending through the slots in the faceplate, a bolt pivotally supported on upstanding projections on the frame for movement between locked and unlocked positions, the projections extending from the frame towards the faceplate, means coupled to the dials and rotatable therewith for moving the bolt to the locked position except when the dials have predetermined rotational positions, and spring means located on the projections between the bolt and the faceplate for urging the bolt to the unlocked position.

38. The combination lock of claim 37, wherein the bolt has slots for receiving the projections, and the projections each have a ledge portion adjacent to the underside of the bolt for pivotally supporting the bolt on the projections.

39. The combination lock of claim 38, wherein the ledge portion slopes away from the underside of the bolt.

40. The combination lock of claim 39, wherein the ledge portion slopes in the direction in which the bolt is pivoted when the bolt is moved to the locked position.

41. The combination lock of claim 37 further comprising a cover plate pivotally supported over the faceplate for covering the dials when the cover plate is in a closed position, and resilient means for biasing the cover plate to the closed position.

* * * * *